US008904811B2

(12) United States Patent
Newman et al.

(10) Patent No.: US 8,904,811 B2
(45) Date of Patent: Dec. 9, 2014

(54) BAFFLE CONTROLLED OSCILLATING FLOW FREEZER

(71) Applicants: Michael D. Newman, Hillsborough, NJ (US); Stephen A. McCormick, Warrington, PA (US)

(72) Inventors: Michael D. Newman, Hillsborough, NJ (US); Stephen A. McCormick, Warrington, PA (US)

(73) Assignee: Linde Aktiengesellschaft, Munich (DE)

( * ) Notice: Subject to any disclaimer, the term of this patent is extended or adjusted under 35 U.S.C. 154(b) by 183 days.

(21) Appl. No.: 13/677,570

(22) Filed: Nov. 15, 2012

(65) Prior Publication Data

US 2014/0130525 A1 May 15, 2014

(51) Int. Cl.

| | |
|---|---|
| ***F25D 25/00*** | (2006.01) |
| ***F25D 3/10*** | (2006.01) |
| ***F25D 3/11*** | (2006.01) |
| ***F25D 13/06*** | (2006.01) |

(52) U.S. Cl.

CPC .. *F25D 3/10* (2013.01); *F25D 3/11* (2013.01); *F25D 13/067* (2013.01)

USPC ..... 62/62; 62/187

(58) Field of Classification Search

CPC ..... F25D 3/11; F25D 13/067; F25D 3/10

USPC ..... 62/63, 374, 378, 380, 186, 187

See application file for complete search history.

(56) References Cited

U.S. PATENT DOCUMENTS

| | | | | |
|---|---|---|---|---|
| 3,403,527 A | | 10/1968 | Berreth et al. | |
| 4,229,947 A | * | 10/1980 | Klee | 62/374 |
| 4,757,691 A | | 7/1988 | Compagnon | |
| 4,783,972 A | * | 11/1988 | Tyree et al. | 62/374 |
| 4,813,245 A | | 3/1989 | Hubert et al. | |
| 4,955,206 A | | 9/1990 | Lang et al. | |
| 5,765,381 A | * | 6/1998 | Renz | 62/63 |
| 5,826,641 A | | 10/1998 | Bierwirth et al. | |
| 6,434,950 B2 | * | 8/2002 | Newman et al. | 62/63 |
| 2001/0025495 A1 | * | 10/2001 | Newman et al. | 62/63 |

(Continued)

FOREIGN PATENT DOCUMENTS

| | | |
|---|---|---|
| EP | 0 024 158 B1 | 11/1983 |
| WO | WO2004/018945 A2 | 3/2004 |

OTHER PUBLICATIONS

International Search Report for PCT/US2013/067465, Date of Mailing: Mar. 19, 2014, Authorized Officer: Blain R. Copenheaver, 88 pp.

(Continued)

*Primary Examiner* — Mohammad M Ali

(74) *Attorney, Agent, or Firm* — Joshua L. Cohen

(57) ABSTRACT

A freezer includes a housing having a sidewall defining a chamber, and an inlet and an outlet in communication with the chamber; a pair of baffle assemblies spaced apart and disposed in the chamber, a first one of the pair movable 90° degrees out of phase from a second one of the pair; a plate disposed in the chamber and extending between the first and second baffle assemblies for dividing a portion of the chamber into an intake zone and an outflow zone; a fan disposed in the chamber between the first and second baffle assemblies and in communication with the intake and outflow zones for providing a gas flow from the intake zone to the outflow zone; and a delivery apparatus in communication with the chamber for delivering a chilling substance to the chamber for reducing a temperature of a product. A method is also provided.

12 Claims, 5 Drawing Sheets

(56) References Cited

U.S. PATENT DOCUMENTS

| | | | | |
|---|---|---|---|---|
| 2007/0062380 | A1* | 3/2007 | Landis et al. | 99/517 |
| 2007/0144191 | A1* | 6/2007 | Viegas et al. | 62/185 |
| 2009/0019869 | A1* | 1/2009 | Girard et al. | 62/168 |
| 2009/0047404 | A1* | 2/2009 | McCormick et al. | 426/524 |
| 2010/0162727 | A1 | 7/2010 | Newman | |
| 2011/0265492 | A1 | 11/2011 | Newman et al. | |

OTHER PUBLICATIONS

European Search Report for EP 13 16 5867 Date of Mailing: Jul. 31, 2013, Authorized Officer: Jan Douwe de Graaf, 4 pp.

* cited by examiner

BAFFLE CONTROLLED OSCILLATING FLOW FREEZER

BACKGROUND

The present embodiments relate to apparatus and methods for providing and controlling air flow and heat transfer across products in freezing systems for example, used with food products.

Known freezers have a fan or a plurality of fans to provide a convective airflow environment to accelerate the freezing rate of products, such as food products, being processed in the freezer. Fans require electrical energy to operate and contribute the thermal loads to the freezing processes which reduces the overall efficiency of the freezer. Therefore, the use of fewer fans is advantageous.

It is also know to pulse or oscillate a flow of gas across the surface of a product for increasing convective surface heat transfer co-efficients. Such a pulsing or oscillating flow of gas can require equipment that is expensive to maintain and more difficult to operate under low temperatures. Sanitation may also be more problematic with such systems.

However, using a single fan assembly to create the same oscillating or pulsating flow is not known, would be less expensive to implement and would reduce sanitary problems for which the food industry is particularly concerned.

The present inventive embodiments provide a freezer which provides the oscillating or pulsing flow of the gas with a single fan assembly.

BRIEF DESCRIPTION OF THE DRAWINGS

For a more complete understanding of the present inventive embodiments, reference may be had to the following description of the embodiments taken in conjunction with the drawing figures, of which.

DETAILED DESCRIPTION OF THE INVENTION

Figure 1:
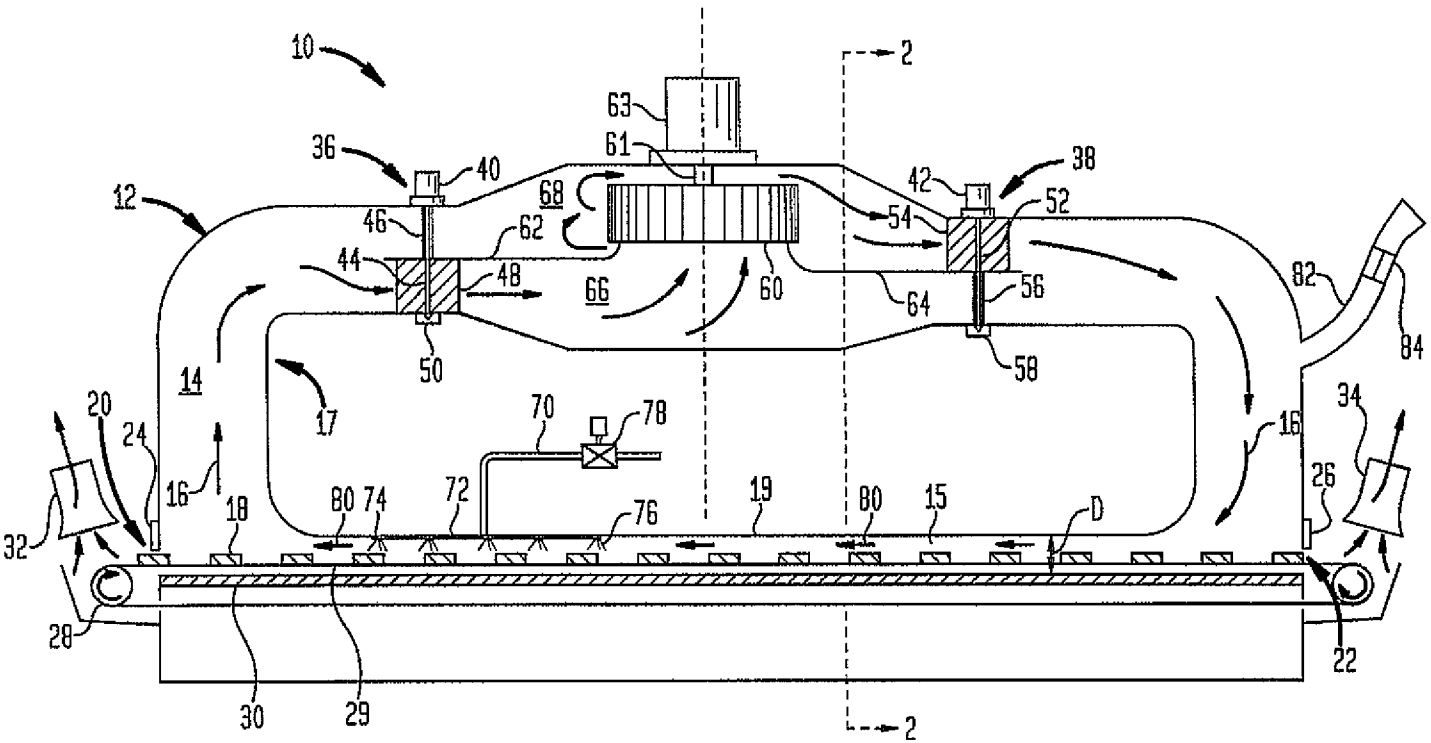
FIG. 1 shows a cross-section of a baffle controlled oscillating flow freezer in a first position constructed to provide an oscillating airflow according to the present embodiments.
Figure 2:
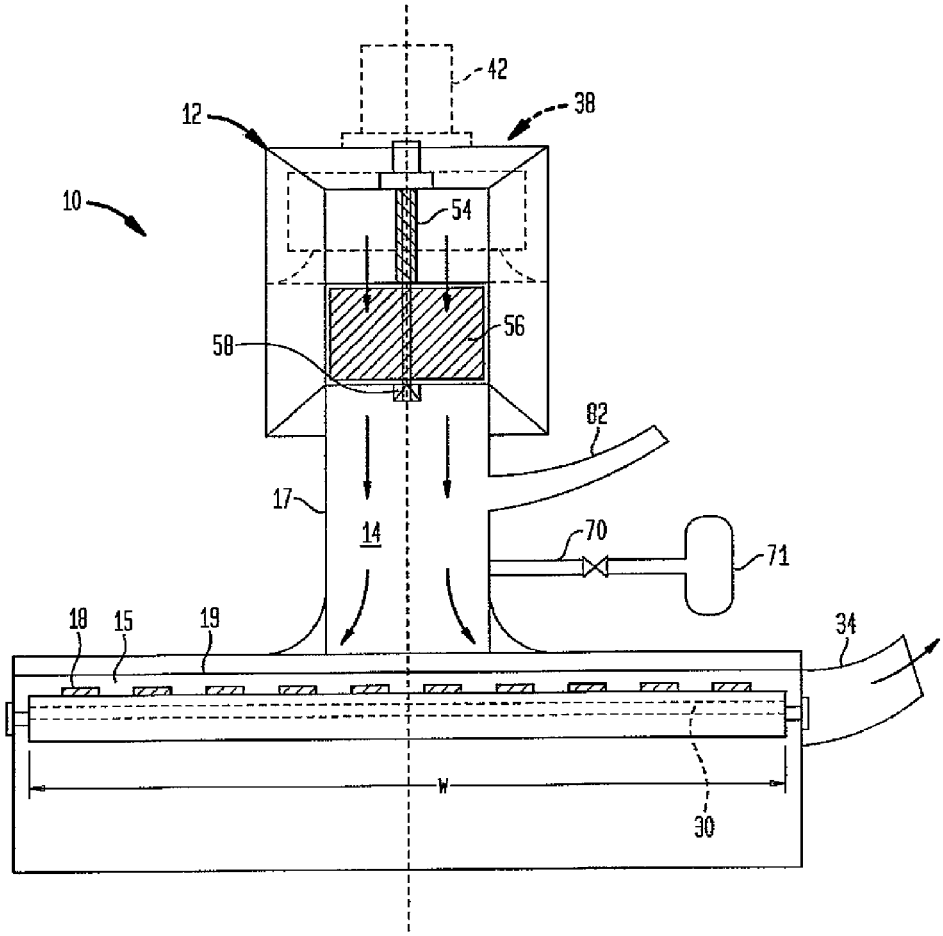
FIG. 2 shows the freezer embodiment along line 2-2 in FIG. 1.

Referring to FIGS. 1 and 2, a freezer apparatus, such as a tunnel freezer, is shown generally at 10, which is constructed to provide an oscillating flow of cryogenic gas to products to be chilled or frozen. The oscillating flow may in one embodiment operate repetitiously at high frequency. The cryogenic gas may be carbon dioxide ($CO_2$) or nitrogen ($N_2$), thereby permitting the apparatus 10 to be used with for example food products, as discussed below.

As used herein, "oscillating flow" refers to the flow of gas moving or traveling back and forth between two points regardless of the manner, number of repetitions or frequency of repetitions by which the oscillating flow is implemented.

The apparatus 10 includes a housing 12 in which a space 14 is provided for providing a chilling or freezing convective gas flow 16 to correspondingly chill or freeze products 18, such as food products, transported through a processing region 15 of the space 14 in the housing. The space 14, and the processing region 15 are provided by an interior wall 17 or duct disposed within the housing 12 as shown for example in FIG. 1. The housing 12 also includes an inlet 20 and an outlet 22. An inlet skirt 24 or flap is provided at the inlet 20, while an outlet skirt 26 or flap is provided at the outlet 22 to retain the gas flow 16 within the region 15. A transport apparatus 28, such as a conveyor belt for example, is disposed for operation to transport the products 18 from the inlet 20 through the region 15 to the outlet 22.

A baffle 30 is disposed in the housing 12 beneath an upper tier 29 or surface of the conveyor belt 28. The baffle 30 may be of solid construction. An inlet exhaust flue 32 is disposed proximate the inlet 20 of the housing 12. An outlet exhaust flue 34 is disposed proximate the outlet 22 of the housing 12. A cross-sectional area of the processing region 15 includes the space of the processing region above the product 18, and below the upper tier 29 of the conveyor belt 28 and to the sides of the belt as shown also with respect to FIG. 2. This cross-sectional area is minimized by a wall portion 19 of the interior wall 17, and the wall portion 19 position assists to maximize airflow velocity and concurrently minimize volumetric flow through the processing region 15. The portion 19 of the interior wall 17 and the baffle 30 co-act to prevent "dead space" above and below said portion and the baffle from interfering with and diluting the oscillating gas flow 16. This construction and arrangement provides for a more intense and effective gas flow across the product 18, and minimizes the cross sectional area of the region 15 to reduce total volumetric flow requirements for the process. A vertical distance "D" or height between the wall portion 19 and the baffle 30 corresponds directly to the cross-sectional air flow area in the freezing chamber. A width "W" of the conveyor belt 28 is therefore fixed. It is most efficient to operate the apparatus 10 with a minimum acceptable height D. The height D is therefore dependent upon a height of the product 18 being transported through the processing region 15. When the cross-sectional area of the processing region 15 is minimized, a velocity of the gas flow 16 on the surface of the product 18 can be increased with a constant volumetric flow.

A pair of baffle assemblies 36,38 are disposed in the space 14. As shown in FIGS. 1 and 2, the assemblies 36,38 may be disposed at opposed sides of the housing 12. Each of the assemblies 36,38 includes a respective actuator 40,42 which may be disposed at an exterior of the housing 12. The baffle assembly 36 includes a shaft 44 extending from the actuator 40 into the space 14. A pair of baffles 46,48 are mounted to the shaft 44 90° out of phase with each other. That is, the baffle 46, which can be the upper baffle, is mounted to the shaft 44 90° out of phase from the baffle 48, which can be the lower baffle. The baffles 46,48 rotate in their respective fixed positions with rotation of the shaft 44. In this manner of construction, the baffles 46,48 rotate in unison with each other. The baffles 46,48 may be rectangular-shaped for example, or perhaps shaped like paddles, and may be constructed of plastic or stainless steel. When the baffles 46,48 are rotated by the shaft 44, at least one of the baffles will be disposed in the space 14 to block or intercept the gas flow 16 in the space. A bearing 50 is mounted to an end of the shaft 44 opposed to the actuator 40 at the interior wall 17 as shown in FIG. 1.

The baffle assembly 38 includes a shaft 52 extending from the actuator 42 into the space 14. A pair of baffles 54,56 are mounted to the shaft 52 90° out of phase with each other. That is, the baffle 54, which can be the upper baffle, is mounted to the shaft 52 90° out of phase from the baffle 56, which can be the lower baffle. The baffles 54,56 rotate in their respective fixed positions with rotation of the shaft 52. In this manner of construction, the baffles 54,56 rotate in unison with each other. The baffles 54,56 may be rectangular-shaped for example, or perhaps shaped like paddles, and may be constructed of plastic or stainless steel. When the baffles 54,56 are rotated by the shaft 52, at least one of the baffles will be disposed in the space 14 to block or interrupt the gas flow 16 in the space. A bearing 58 is mounted to an end of the shaft 52 opposed to the actuator 42 at the interior wall 17 as shown in FIG. 1.

A fan 60 or blower is mounted in the space 14 between the baffle assemblies 36,38. The fan 60 is mounted for rotation on a shaft 61 which is connected to a motor 63 shown disposed external to the housing 12.

A pair of flow divider plates 62,64 are mounted in the space 14 between the baffle assemblies 36,38 as shown for example in FIG. 1. Each of the flow dividers 62,64 is constructed as a solid member of plate through which a corresponding one of the shafts 44,52 pass. As shown in FIG. 1, such construction results in the baffles 46,54 being the upper baffles (above the dividers 62,64), while the baffles 48,56 are the lower baffles (below the dividers 62,64). The dividers 62,64 each extend to the blower 60 so that there is provided an intake zone 66 below the dividers 62,64, and an out flow zone 68 above the dividers as shown in FIG. 1, for a purpose to be described hereinafter. The baffles 46,48 rotate to either impede or allow flow 16,21 into the zones 66,68. For example, one hundred percent (100%) of the flow 16 in space 14 is then either negative pressure (baffle 48 open, baffle 46 closed) or positive pressure (baffle 48 closed, baffle 46 open). A corresponding opposite arrangement would occur simultaneously regarding the baffle assembly 38 and the flow 21 with respect to the baffles 54,56. The space 14 is therefore divided into two sections near the blower 60 by the positioning of the flow dividers 62,64, as shown for example in FIGS. 1 and 3.

The flow dividers 62,64 and the interior wall 17 or ductwork may be of solid construction to thereby prevent air or gas flow therethrough.

A liquid cryogen provided, $CO_2$ or $N_2$, will usually phase change into a gaseous—solid phrase when injected into the processing region 15. A pipe 70 for delivering the cryogen to the apparatus 10 has a first end connected to a manifold 72 from which at least one or a plurality of nozzles 74 are in communication therewith. The manifold 72 may be disposed in the region 15. The nozzles 74 provide a cryogen spray 76 or jet into the processing region 15 to freeze at least a surface of the products 18. An opposite end of the pipe 70 is connected to a source 71 of liquid cryogen. The pipe 70 includes a control valve 78 for controlling an amount of the liquid cryogen to be introduced through to the manifold 72.

The wall portion 19 and the baffle 30 coact to provide the processing region 15 within the space 14. The cross section of the region 15 is kept to as small a volume as possible in order to provide for increased velocity of a cryogen airflow 80 across the products 18, which in turn provides for increased heat transfer to the products.

An exhaust pipe 82 is in communication with the space proximate the outlet 22. The exhaust pipe includes a flapper 84 disposed therein for movement for a purpose to be described below.

The housing 12 may be for example 3-20 meters in length and constructed as a tunnel freezer. The inlet and outlet skirts 24,26 can be constructed of rubber, plastic or stainless steel and are adjustable depending upon the dimensions of the products 18 entering and being discharged from the processing region 15.

The apparatus 10 oscillates cold gas across the product 18, such as a food product, during a freezing process. Referring initially to FIGS. 1-2, the conveyor belt 28 transports for example food products 18 from the inlet 20 to the processing region 15 of the apparatus 10. The cryogenic injection assembly is arranged such that the manifold 72 is located in the processing region 15, but could for example be disposed more closely to the inlet 20 than to the outlet 22. The manifold will have at least one or alternatively a plurality of nozzles 74. The products 18 being transported by the conveyor belt 28 are exposed to the cryogenic spray 76 as they pass in proximity to the nozzles 74. However, the gas flow 80 provides further heat transfer effect to the products 18 as described below. The products exit the processing region 15 of the apparatus 10 at the outlet 22.

The baffle assemblies 36,38 work in unison, and can be rotated in unison approximately 90 degrees out of phase with each other. Referring still to FIGS. 1-2, a convective gas flow 16 becomes the cryogen air flow 80 upon exposure to the spray 76 emitted by the at least one nozzle 74. The food products 18 are contacted by the cryogen spray 76 and at least crust frozen as they proceed along the processing region 15 to the outlet 22. As shown in FIGS. 1 and 2, the convective gas flow 16 and the cryogen air flow 80 are in a circuitous path through the space 14 of the apparatus 10.

The baffle assembly 36 is arranged such that the upper baffle 46 blocks a portion of the space 14, while the lower baffle 48 is positioned such that the convective gas flow 16 is not impeded by the baffle 48 and is drawn into the intake zone 66 by the pull of the fan 60. The baffle assembly 38 is positioned 90° out of phase from the baffle assembly 36. That is, the baffle assembly 38 has the upper baffle 54 aligned in the same direction as the baffle 48, while the lower baffle 56 is aligned in the same direction as the upper baffle 46 of the baffle assembly 36. Such alignment provides for the convective gas flow 16 to pass by the lower baffle 48 into the intake zone 66 to be drawn by the fan 60 into the outflow zone 68, and thereafter proceed from the outflow zone 68 to bypass the upper baffle 54 (but blocked by the lower baffle 56) into the processing region 15 where it chills the food product 18 and is recharged with the cryogen spray 76.

Figure 3:
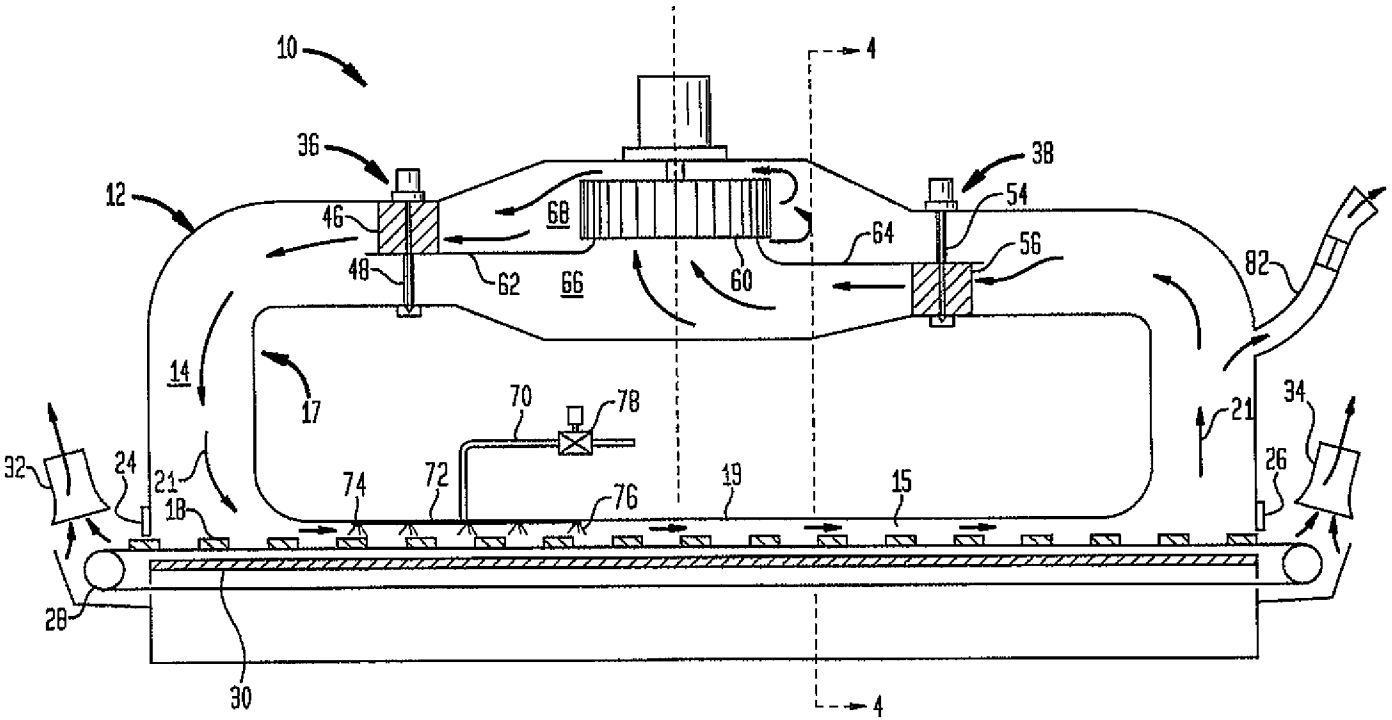
FIG. 3 shows a cross-section of the baffle controlled oscillating flow freezer in a second position constructed to provide an oscillating airflow according to the present embodiments.
Figure 4:
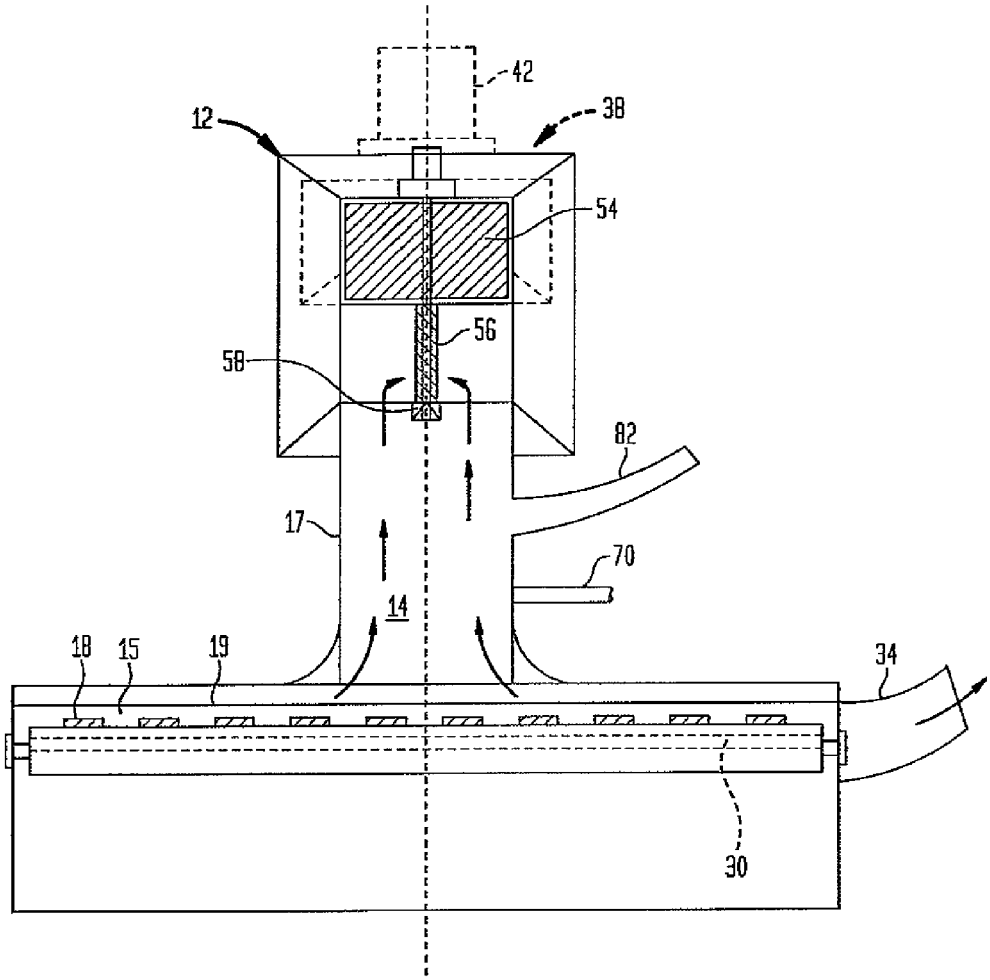
FIG. 4 shows the freezer embodiment along line 4-4 in FIG. 3.

Referring to FIGS. 3-4, the convective gas flow has been reversed by the baffle assemblies 36,38 and is shown generally at 21. The direction of the convective gas flow 21 is counterclockwise to the clockwise direction of gas flow 16 of FIGS. 1-2. Such is accomplished by the baffle assemblies 36,38 being rotated 90° such that the convective gas flow 21 is drawn past the lower baffle 56, because the upper baffle 54 blocks the space 14, and into the intake zone 66 by the fan 60. The convective gas flow 21 is drawn from the intake zone 66 through the fan and exhausted into the outflow zone 68 where it passes by the upper baffle 46, because the lower baffle 48 has now been pivoted to close the space 14. Even though the fan 60 continues to draw the convective gas flow 21 as it would the gas flow 16, because the baffle assemblies 36,38 have been pivoted 90° with respect to each other the circulation of the gas flows 16,21 has been reversed, as shown comparing FIGS. 1 and 3.

The positioning of the flow dividers 62,64 defines the distinct zones of the intake zone 66 and the outflow zone 68 so that movement of the baffle assemblies 36,38 can effect the circulation in the space 14 without having to change the rotary direction of the fan 60.

The inlet skirt 24 and the outlet skirt 26 are in the closed position as shown in FIGS. 1 and 3 to contain the chilling or freezing atmosphere within the space 14. To the extent any of the convective gas flow 16,21 escapes through the inlet 20 and/or the outlet 22, the inlet exhaust flue 32 and the outlet exhaust flue 34 direct the escaping gas away from the apparatus and perhaps to a location remote from the area where the apparatus 10 and operational personnel are located.

Figure 5:
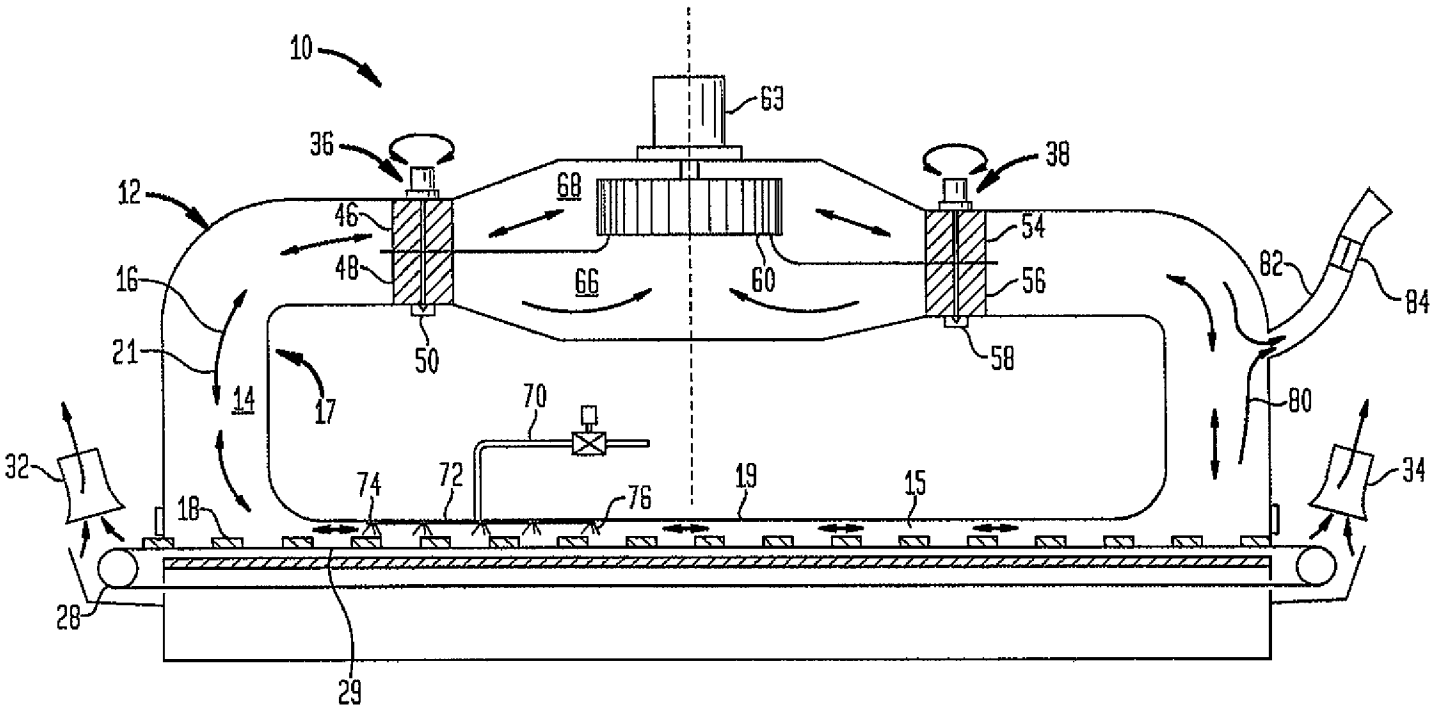
FIG. 5 shows a cross-section of the oscillating flow provided by the freezer of FIGS. 1 and 3.

Referring now to FIG. 5, oscillation of the convective gas flow 16,21 is shown. That is, periodically pivoting the baffle assemblies 35,38 in unison can operate the convective gas flows 16,21 in clockwise and counterclockwise directions, respectively. For example, the baffle assemblies 36,38 can be maintained in their position for a period of time of for example 0.5-10 seconds, after which the baffle assemblies 36,38 are rotated in unison, by for example known timers or controllers (not shown) which will alter the gas flow to be in an opposite direction.

Even though the manifold 72 for the spray 76 of cryogen is shown disposed closer to the inlet 20 than the outlet 22, use of the exhaust pipe 82 can be used to control an overall mass of the cryogen gas in the processing region 15. That is, as the baffle assemblies 36,38 pivot in unison after a select time period, the flapper 84 in the exhaust pipe 82 can be opened at select periods of time to exhaust some of the cryogen airflow 80 in the space 14 such that a colder mass of the cryogen atmosphere in the space 15 is drawn from the inlet 20 to the outlet 22. In this manner of operation, a specific area of the processing region 15 can retain a large mass of colder cryogen gas flow to freeze the products 18.

In addition, as the overall flow of the gas mass in the processing region 15 is directed to the outlet 22, the convective gas flows 16,21 warm during the freezing process which thereby provides a temperature gradient in the processing region 15. With the baffle assemblies 36,38 being operated by for example electronic controls (not shown), a temperature gradient can be entered into an input for the electronic control system (not shown) for operating the baffle assemblies 36,38 at their most efficient setting depending upon the type of products 18, the amount of the products and the extent to which the products are to be frozen. That is, the temperature gradient is established from the inlet 20 to the outlet 22 by alternating a duration of time that the baffle assemblies 36,38 are actuated. For example, a position shown of the apparatus 10 in FIG. 3 could be retained for a period of time of two (2) seconds, and the position of the apparatus demonstrated in FIG. 1 can be held for a period of time of 1.5 seconds. This allows for a net positive volumetric flow of gas to be moved from the inlet 20 to the outlet 22. In certain instances, it may be necessary to reverse the aforementioned process and move a flow of gas to the inlet 20 of the apparatus 10. In such an instance, the manifold 72 with its at least one nozzle 74 would be positioned closer to the outlet 22 of the apparatus, while another exhaust with a flapper would be added at the inlet 20 of the apparatus.

As shown in FIGS. 1-4, as the baffle assemblies 36,38 are rotated 90° with respect to each other, the baffles 46,48 and 54,56 coact with the flow dividers 62,64 to adjust and control the gas flow 16 through the intake zone 66 and the outflow zone 68. By operating the baffle assemblies 36,38 90° out of phase and always moving same in unison, the intake zone 66 provides a suction area, while the outflow zone 68 provides a discharge area for the space 14. The baffles 46,48 of the baffle assembly 36 and the baffles 54,56 of the baffle assembly 38 are shown in broken lines in FIG. 5 to represent movement of the baffles and also that they are in different opposed positions depending upon operation of the apparatus 10.

A temperature gradient may also be provided by the apparatus 10 and the method employed by the apparatus. To establish the temperature gradient, the stationary position time of the baffle assemblies 36,38 is increased, thereby pulling more gas in one direction. When the gas is forced to the outlet 22 it can then be bled from the processing region 15 through the exhaust pipe 82.

The apparatus 10 and method of the present inventive embodiments provides for increased efficiency for using cryogen to chill or freeze the products 18. The apparatus 10, being able to operate at specific temperature gradients, will also contribute to increased processing efficiencies. There are fewer moving parts and therefore less maintenance for the apparatus 10.

It will be understood that the embodiments described herein are merely exemplary, and that one skilled in the art may make variations and modifications without departing from the spirit and scope of the invention. All such variations and modifications are intended to be included within the scope of the invention as described and claimed herein. Further, all embodiments disclosed are not necessarily in the alternative, as various embodiments of the invention may be combined to provide the desired result.

What is claimed is:

1. A freezer for a product, comprising:

a housing having a sidewall defining a chamber in the housing, and an inlet and an outlet in communication with the chamber;

a pair of baffle assemblies spaced apart and disposed in the chamber, a first one of the pair movable 90° degrees out of phase from a second one of the pair;

a plate disposed in the chamber and extending between the first and second baffle assemblies for dividing a portion of the chamber into an intake zone and an outflow zone;

a fan disposed in the chamber between the first and second baffle assemblies and in communication with the intake and outflow zones for providing a gas flow from the intake zone to the outflow zone; and a delivery apparatus in communication with the chamber for delivering a chilling substance to the chamber for reducing a temperature of the product.

2. The freezer of claim 1, wherein the delivery apparatus comprises a cryogen injection apparatus having a first end in communication with the chamber and a second end in communication with a source of liquid cryogen.

3. The freezer of claim 2, further comprising a transport apparatus extending from the inlet through the chamber to the outlet for moving the product through the freezer for exposure to the chilling substance.

4. The freezer of claim 2, wherein the cryogen injection apparatus comprises at least one nozzle connected to the first end of the cryogen injection apparatus for providing the chilling substance to the chamber.

5. The freezer of claim 2, wherein the cryogen injection apparatus comprises a manifold connected to the first end, the manifold having at least one nozzle for providing the chilling substance to the chamber.

6. The freezer of claim 1, further comprising a gas exhaust pipe in communication with the chamber proximate at least one of the inlet and the outlet for controlling removal of a portion of the gas flow from the chamber and preventing atmosphere external to the freezer from entering the chamber.

7. The freezer of claim 1, further comprising an inlet exhaust positioned proximate the inlet, and an outlet exhaust positioned proximate the outlet.

8. The freezer of claim 1, further comprising an inlet door mounted to the housing at the inlet and operable for restricting atmosphere external to the housing from entering the chamber, and an outlet door mounted to the housing at the outlet and operable for restricting the atmosphere external to the housing from entering the chamber.

9. The freezer of claim 2, wherein the liquid cryogen is selected from the group consisting of carbon dioxide and nitrogen.

10. The freezer of claim 1, wherein each of the first and second baffle assemblies comprise:

a shaft rotatable in the chamber and extending through the plate, an upper baffle connected to the shaft above the plate; and a lower baffle connect to the shaft below the plate, the lower baffle positioned on the shaft out of phase from the upper baffle.

11. The freezer of claim 10, wherein the lower baffle is positioned on the shaft 90° out of phase from the upper baffle.

12. The freezer of claim 1, wherein the product comprises a food product.

* * * * *